US007172452B1

(12) United States Patent
Laws

(10) Patent No.: US 7,172,452 B1
(45) Date of Patent: Feb. 6, 2007

(54) MODULAR CABLE GUIDE

(76) Inventor: Jason Jay Laws, 31351 Countryside Lance, Castaic, CA (US) 91384

( * ) Notice: Subject to any disclaimer, the term of this patent is extended or adjusted under 35 U.S.C. 154(b) by 0 days.

(21) Appl. No.: 11/140,717

(22) Filed: May 31, 2005

Related U.S. Application Data

(60) Provisional application No. 60/575,731, filed on Jun. 1, 2004.

(51) Int. Cl.
*H01R 13/58* (2006.01)

(52) U.S. Cl. ..... 439/465

(58) Field of Classification Search ..... 439/465, 439/449, 499, 701, 457, 596, 467, 587; 336/175, 336/65, 92; 176/92, 138, 135, 84, 76
See application file for complete search history.

(56) References Cited

U.S. PATENT DOCUMENTS 4,029,896 A * 6/1977 Skinner ..... 174/138 F
4,902,856 A * 2/1990 Miller ..... 174/91
5,356,023 A * 10/1994 Krupa ..... 220/4.24
5,763,835 A * 6/1998 Huynh-Ba et al. ..... 174/92
5,793,921 A * 8/1998 Wilkins et al. ..... 385/135
5,835,326 A * 11/1998 Callaway ..... 361/111
6,335,672 B1 * 1/2002 Tumlin et al. ..... 336/175
6,544,070 B1 * 4/2003 Radliff ..... 439/596
6,726,503 B2 * 4/2004 Waddell et al. ..... 439/465

* cited by examiner

*Primary Examiner*—Alexander Gilman
(74) *Attorney, Agent, or Firm*—Colin P. Abrahams

(57) ABSTRACT

A cable guide module comprises a body portion having at least one groove therein extending across the body portion, the groove having a first open end and a second open end. An attachment mechanism is provided on the body portion for releasably securing the body portion of a first cable guide module to the body portion of a second cable guide module such that the grooves of the first and second cable guide modules together define a channel.

26 Claims, 10 Drawing Sheets

MODULAR CABLE GUIDE

CROSS-REFERENCE TO RELATED APPLICATION

This application claims the benefit of U.S. Provisional Patent Application No. 60/575,731, filed Jun. 1, 2004, which is incorporated herein by reference in its entirety.

FIELD AND BACKGROUND OF THE INVENTION

This invention relates to a modular cable guide. In one preferred form, the invention relates to a cable guide comprised of a single molded body component which can be assembled with other identical body components in various configurations so as to create a modular cable guide of desired size. In another form, the invention also comprises an end module or piece, which can be attached to the assembled body components at each end thereof, in order to make the modular cable guide more stable and user-friendly.

Cables are used extensively in many situations for connecting electric or electronic devices with respect to each other, and also to power sources. One particular area where many cables may be used may be in film or television production locations or sound studios, which includes a myriad of equipment components such as lighting, cameras, electrical props and other such devices. A multiplicity of cables may also be found when connecting computers and computer-related devices to each other. Yet another example where many cables may be found are on construction sites or in seminar rooms, where speakers, microphones, amplifiers, lighting, projectors and other equipment may typically be needed.

In many instances, the devices are separated from each other by significant distances, and it is necessary that they be connected to other devices in the network, as well as to possible power sources, by dedicated cables which may need to extend over a considerable distance. Where many such devices are used, this can, of course, easily lead to a tangle of cables which are undesirable for several reasons. First, it is more difficult to identify specific cables which may be associated with a particular device. Second, the tangle of cables may also lead to dangerous conditions, where people may trip over the cables, or the movement of other equipment may be impeded by such cables causing an obstacle to the locating of equipment at a particular site.

In an effort to control and lay out the plurality of cables that may be needed at a particular site, certain cable guides are sometimes used. The cable guides may have specially designed configurations which render the cables less of an obstacle to the unimpeded flow of people and other equipment. One procedure used for holding electrical cables in place and keeping them stationary involves the so-called "basket weaving" method, done with a rope or sash.

SUMMARY OF THE INVENTION

In one aspect of the invention, there is provided a modular cable guide which comprises a body module, which, when coupled with a similar body module, provides one or more channels for receiving and directing one or more cables. Preferably, a pair of body modules is connected to each other in a snap-on fashion so that they can remain fastened to each other under normal conditions, but, with the right relative movement between the body modules, can also be easily separated from each other.

Preferably, each body module comprises one or more channels, preferably parallel to each other in the case of a body module having a plurality of channels, with each channel comprising a substantially semi-circular shape. The semicircular channel of one body module is configured with respect to the body module so that it will register or correspond with a semi-circular channel of a second body module when the two are connected together.

In one form, therefore, each of a pair of body modules is connectable to the other so as to define a closed channel.

In another preferred form of the invention, the body modules have end portions which are designed so that the end of one body module can be fastened to the end of another similar body module. In this way, a modular cable guide can be assembled so as to define the desired number of cable channels, according to the number that may be needed in a particular context.

Preferably, the ends of adjacent body modules are fastened to each other in a snap-on fashion, so that the fastening mechanism is reasonably secure, but with the correct relative movement between adjacent body modules, the body modules can be separated from each other.

The invention therefore provides for, in one preferred form, a single body module of a specific shape, which can be coupled with other similar body modules in various manners so as to form a cable guide of a variable length, having the desired number of channels to suit a particular situation.

The invention may further comprise an end module, which can be fastened to the body module. Thus, when a cable guide of desired shape and configuration has been formed by the assembly of a plurality of body modules, the assembled body modules will have a first and second end. An end module is connectable to the first and second ends, preferably to provide the fully assembled device with additional stability.

Preferably, each body module comprises one or more locking tabs which are configured on the body module so as to engage and releasably lock with corresponding locking tabs on an adjacent body module.

The shape of the body modules may be such that the assembled modular cable guide is of rectangular shape, circular shape, square or any other desired shape. Further, the side walls may be inclined or beveled to facilitate the moving of equipment such as on carts or wheeled platforms, over the assembled guide.

According to one aspect of the invention, there is provided a cable guide module comprising: a body portion having at least one groove therein extending across the body portion, the groove having a first open end and a second open end; and attachment means on the body portion for releasably securing the body portion of a first cable guide module to the body portion of a second cable guide module such that the grooves of the first and second cable guide modules together define a channel.

The body portion may comprises a plurality of grooves therein which are substantially parallel to each other. The grooves may be substantially semicircular in shape, of substantially the same size, and/or of at least two sizes.

Preferably, the body portion is approximately rectangular in shape including a pair of side walls and a pair of end walls, the groove extending between the side walls. The end walls may comprise a fastening member which can be releasably secured to a fastening member of an adjacent body portion. In one embodiment, the fastening member on one end of the body portion comprises a male connector and a female connector and the fastening member on the other end of the body portion comprises a female connector and male connector, the male connector and the female connector on the one end being complementary with and fastening to the female connector and the male connector on the other end.

Preferably, the male connector comprises a locking arm having a raised tab thereon extending outwardly from the end of the body portion and a hood member at least partially surrounding the locking arm, the female connector comprises a locking arm having a raised tab thereon extending outwardly from the end of the body portion and a hood recess at least partially surrounding the locking arm, and the raised tabs on the locking arms of the male and female connectors respectively being configured so that they can releasably engage one another, and the hood member being dimensioned for receipt in the hood recess.

In one form, the attachment means comprises at least one lock member formed on the body portion. The body portion may comprise intermediate walls between adjacent grooves, and the lock member is located on the intermediate walls. The body portion may have substantially opposing sides and the lock member may comprise a lock wall at one side of the body portion and a fingerlike projection extending from the lock wall toward an other side of the body portion, the fingerlike projection having a tab member for engaging a like tab member on another body portion.

Preferably, the tab member on the fingerlike projection comprises a downwardly directed bulge having an inclined slide surface and an inclined abutment surface, the bulge being positioned with respect to the body portion so that it is at least partially slightly beyond a center line and away from the lock wall, between the opposing sides of the body portion. The fingerlike projection and the intermediate wall over which it is positioned define a space therebetween for receiving a fingerlike projection of another body portion, the space being open below the bulge and closed at the lock wall, the lock wall defining a barrier to limit movement of a fingerlike projection received therein. Further, the intermediate wall may have a crest thereon near the opposing side opposite the opposing side where the lock wall is located, an elongate depression being formed between the crest and the lock wall.

The end walls of the body portion may be stepped and comprises a raised step and a lowered step, with a grooved recess along at least a portion of the raised step and a corresponding projecting strip on the lowered step.

In another embodiment, the cable guide module further comprises an end module releasably connectable to an end wall of the body portion. The end wall of the body portion preferably comprises a fastening member having a male connector and a female connector and the end module comprises an end face having a fastening member having a female connector and male connector, the male connector and the female connector on the end wall of the body portion being complementary with and fastening to the female connector and the male connector on the end face of the end module.

The cable guide module may further comprise lighting thereon, have retractable arms for stabilizing the body portion, and be comprised of polyurethane, polypropylene, ABS plastic or any other suitable material.

According to another aspect of the invention, there is provided a modular cable guide comprised of a plurality of assembled cable guide modules, each cable guide module comprising: a body portion having at least one groove therein extending across the body portion, the groove having a first open end and a second open end; and attachment means on the body portion for releasably securing the body portion of a first cable guide module to the body portion of a second cable guide module such that the grooves of the first and second cable guide modules together define a channel.

In yet a further aspect of the invention, there is provided a method of forming a modular cable guide comprising: forming a body portion having at least one groove therein extending across the body portion, the groove having a first open end and a second open end; providing attachment means on the body portion for releasably securing the body portion of a first cable guide module to the body portion of a second cable guide module such that the grooves of the first and second cable guide modules together define a channel; and snapping together the first cable guide module and the second cable guide module using the attachment means.

DETAILED DESCRIPTION OF THE INVENTION

The present invention relates to a modular cable guide, which may be in various forms and shapes. An important feature of the modular cable guide of the invention relates to the construction of a single or minimal number of modules which can be used with other such modules to configure a cable guide of desired size.

Reference is now made to the accompanying drawings which show certain embodiments of the invention. However, it should be understood that the invention is not limited to the precise construction of the modular cable guide as described herein, but may take a number of different forms and configurations within the scope of the invention.

Figure 1:
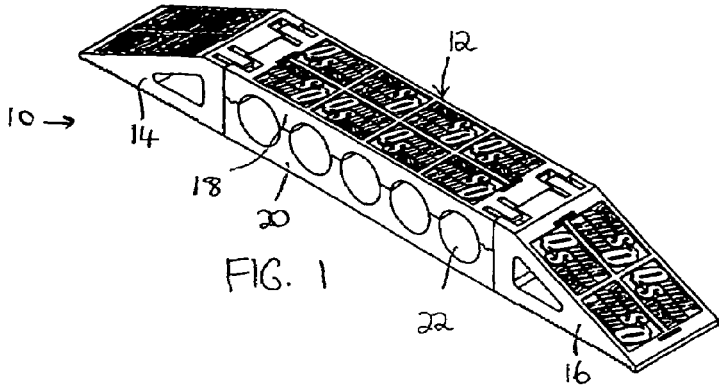
FIG. 1 is a perspective view of an assembled modular cable guide incorporating the various components of one embodiment of the invention.
Figure 2:
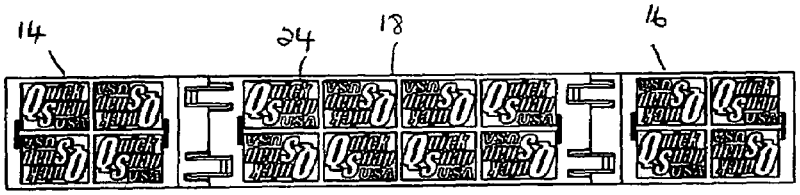
FIG. 2 is a top view of the modular cable guide shown in FIG. 1 of the drawings.
Figure 3:
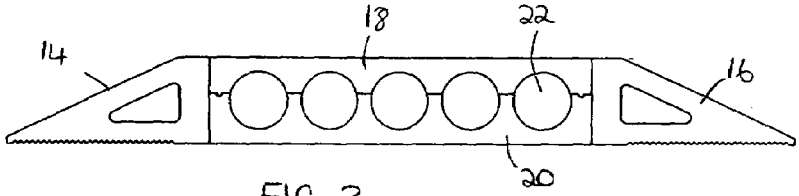
FIG. 3 is a side view of the modular cable guide shown in FIG. 1 of the drawings.

Referring to the drawings, and particularly to FIGS. 1 to 3, there is shown a modular cable guide 10, which comprises a central portion 12, and end portions 14 and 16. Each of the end portions 14 and 16 is of substantially the same construction and configuration. The precise details of these end portions 14 and 16 is discussed below.

The central portion 12 comprises an upper cable module 18 and a lower cable module 20. The upper and lower cable modules 18 and 20 are of substantially identical configuration and construction, and are located with respect to each other so as to form a series of channels 22. In the embodiment shown in FIG. 1 and other drawings, five such channels 22 are shown. The use of five channels is intended as an example only, and the central portion 12 of the modular cable guide 10 may in fact contain any desired number of channels 22, including only one channel, or, six or more channels, as desired.

With reference to FIGS. 2 and 3 of the drawings, FIG. 2 shows a top view of the modular cable guide 10, illustrated in FIG. 1, also indicating the connection mechanism between the end portions 14 and 16 with the central portion 12. It will be seen that the central portion 12 has an upper surface 24 which may have a textured surface to prevent slipping, and stabilizing the use of the modular cable guide 10. In the particular illustration in FIG. 2, the textured upper surface 24 comprises a series of blocks which may include serial repetitions of the brand name of the modular cable guide 10.

FIG. 3 of the drawings shows a side view of the modular cable guide 10 seen in FIG. 1 of the drawings, illustrating the components already described. It will be seen in this Figure that the end portions 14 and 16 comprise a base wall 26, at least a portion of which has a serrated or zigzag surface. Such a surface may facilitate the stability of the modular cable guide 10 when mounted on a surface, to help prevent slippage thereof. It will be noted that the upper surface 24 of the modular cable device 10 can, depending on the construction, also constitute the lower surface thereof, and the textured aspect therefore also helps prevent slippage when the modular cable guide 10 is used on a surface.

Figure 4:
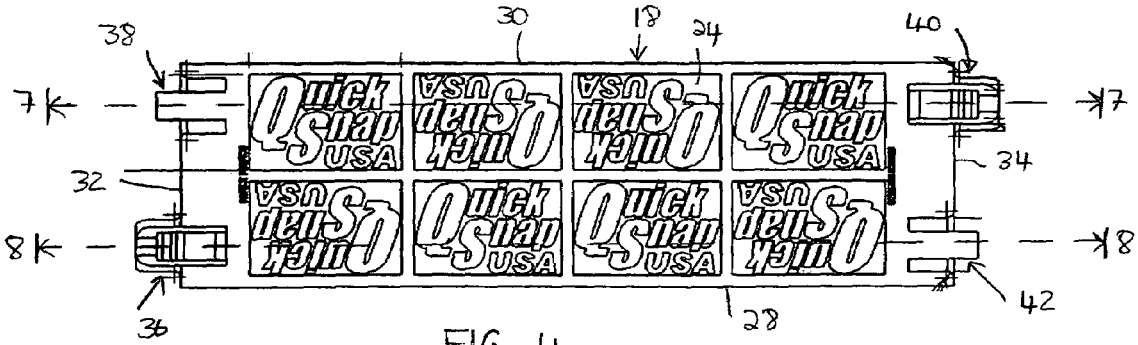
FIG. 4 is a top view of a body module comprising the modular cable guide of the invention.

With reference to FIG. 4 of the drawings, there is shown the top view of a stand-alone cable module, such as either one of cable modules 18 or 20, shown in FIG. 1 of the drawings. The cable module 18 comprises the upper surface 24, and side walls 28 and 30. Further, the cable module 18 comprises a first end wall 32 and an opposite second end wall 34.

The first end wall 32 has extending therefrom, near side wall 28, a male connector 36, and, near side wall 30, a female connector 38. At the second end wall 34, a male connector 40 is near the side wall 30, while a female connector 42 is near the side wall 28. The male connectors 36 and 40 are of substantially identical construction, while the female connectors 38 and 42 are also substantially of identical construction, as will be described more fully below. The male connector 36 and female connector 38 extending from the first end wall 32 will engage with a female connector 42 and male connector 40 located respectively on opposite sides of the cable module 18, in order to effect the connection of a cable module 18 to an adjacent cable module, if so desired.

Figure 5:
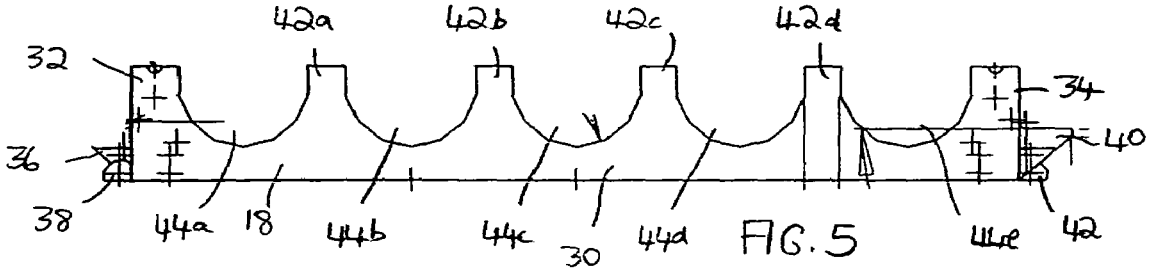
FIG. 5 is a side view of the body module shown in FIG. 4 of the drawings.

FIG. 5 of the drawings shows a side view of the cable module 18 illustrated in FIG. 4 of the drawings. Thus, there is shown in FIG. 5 the cable module having side walls 30, upper surface 24, second end wall 34, and first end wall 32. Between the end walls 32 and 34, there are four intermediate walls 42*a*, 42*b*, 42*c* and 42*d*.

Between end wall 32 and intermediate wall 42*a* there is defined a substantially semi-circular canal 44*a*, while canals 44*b*, 44*c*, 44*d* and 44*e* are formed between intermediate walls 42*a* and 42*b*, 42*b* and 42*c*, 42*c* and 42*d*, and 42*d* and end wall 34 respectively. All of the canals 44*a* to 44*e* are substantially the same size. When a canal 44*a* combines with a canal 44*e*, for example, on a cable module, not shown, in FIG. 5 but mounted above the cable module 18, a cable conduit channel 22 is formed which is completely enclosed, and shown in the assembled modular cable guide 10 as illustrated in FIGS. 1 and 3 of the drawings.

In FIG. 5, extending from the first end wall 32 there is shown the male connector 36, and extending from the second end wall 34, there is also shown the male connector 40. A portion of the female connector 38 is also shown extending from the first end wall 32, and a portion of the female connector 42 is shown extending from the second end wall 34.

The side view shown in FIG. 5 shows the various internal intermediate walls 42. These intermediate walls 42, as will be discussed further below, also form locking members by means of which a first cable module 18 can be secured to a second cable module. More details relating to the structure of these locking members will be described hereunder.

Figure 6:
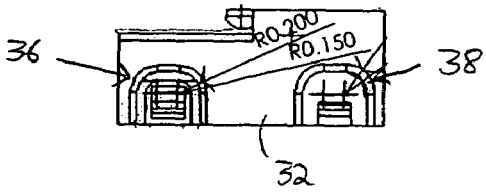
FIG. 6 is an end view of the body module shown in FIG. 4 of the drawings.

With reference to FIG. 6, there is shown a side view of the cable module 18 illustrated in FIG. 4 of the drawings, including the end wall 32. Constructed into the end wall is the female connector 38, and the male connector 36.

Figure 7:
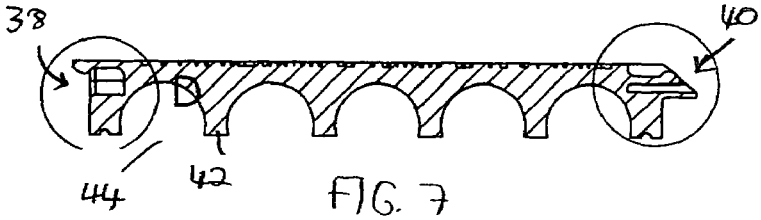
FIG. 7 is a cross-section through line 7—7 of the body module shown in FIG. 4 of the drawings.
Figure 8:
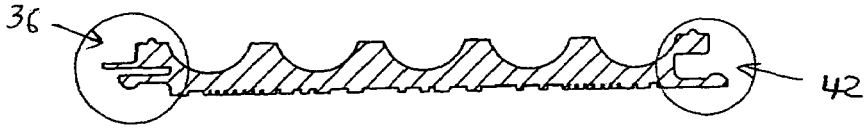
FIG. 8 is a cross-section through line 8—8 shown in FIG. 4 of the drawings.

With reference to FIG. 7 of the drawings, there is shown a cross-section through the cable module 18 along line 7—7 of FIG. 4 of the drawings. In FIG. 7, a cross-section through the female connector 38 can be seen at one end, and the cross-section through the male connector 40 can be seen at the other end.

Figure 10:
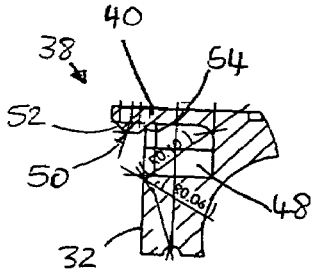
FIG. 10 is a detail of the other end of the body module shown in FIG. 7 of the drawings.

A detail of the female connector 38 is illustrated in FIG. 10 of the drawings. The female connector 38 comprises a side lock tab 46 extending away from the end wall 32. Further, within the end wall 32 there is formed a hood recess 48. The side lock tab 46 includes a projection 50 having a side wall 52, and an abutment wall 54. The female connector 38 engages with corresponding components on the male connector, as discussed below.

Figure 9:
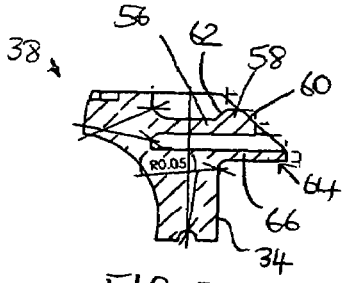
FIG. 9 is a detail of one end of the body module shown in FIG. 7 of the drawings.

The male connector 40 on the cable guide 18 is shown in FIG. 7 of the drawings, and a detail thereof can be seen in FIG. 9 of the drawings. FIG. 9 shows end wall 34, and a side wall tab 56 extending therefrom. The side wall tab 56 has a projection 58, the projection having a slide wall 60 and an abutment wall 62.

A hood 64 also extends outwardly from the second end wall 34. The hood 64 has a top wall 66, and side walls 68 and 70, seen in several of the drawings, but possibly best understood from a viewing of FIG. 15. The side walls 68 and 70 extend diagonally from the end of the hood 64 to the second end wall 34.

The female connector 38 and male connector 40 are able to releasably engage each other so that adjacent cable modules 18 can be serially attached to each other depending on the number of cable conduit channels 22, which are required. In this regard, the hood 64 of the male connector 40 is received within the hood recess 48 of the female connector in an adjacent cable module. The side lock tab 46 of the female connector 38 at the same time engages the side lock tab 56 of the male connector 40. When assembling adjacent cable modules, the slide wall 52 engages the slide wall 60, causing each of the resilient side wall tabs 46 and 56 to move away from each other as the cable modules are brought together. As the assembly progresses, the projections 50 and 58 of the female connector 38 and male connector 40 respectively pass each over other, and the side lock tabs 46 and 56 become releasably locked to each other when the abutment wall 54 of the female connector lies adjacent the abutment wall 62 of the male connector. The fastening of the male and female connectors 38 and 40 respectively in this way ensures a secure connection of the cable modules 18, but the connection can be released by pulling the modules away from each other to essentially reverse the process described above with respect to the fastening of the cable modules.

It will, of course, be appreciated that there is a double connection at each end of the cable module 18 so that two attachment mechanisms are provided between two adjacent cable modules 18, to provide a stable fastening therebetween.

Figure 11:
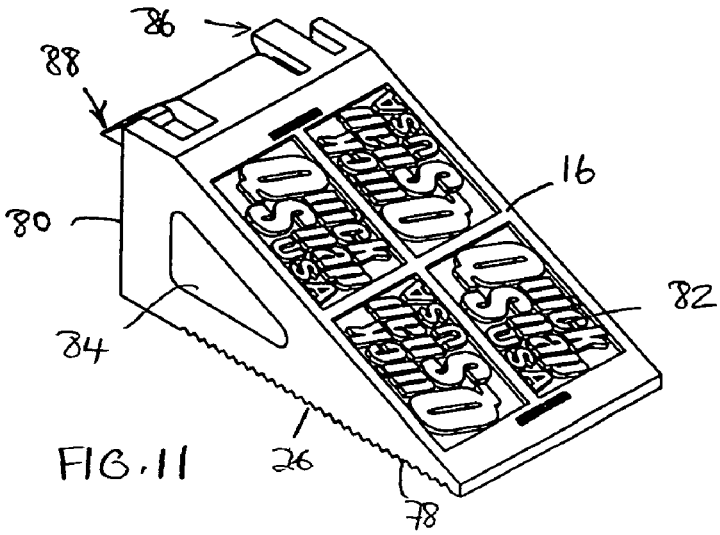
FIG. 11 is a perspective view of an end module in accordance with one aspect of the invention.
Figure 12:
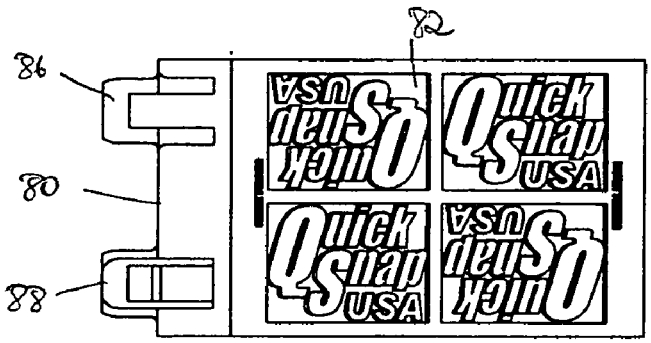
FIG. 12 is a top view of the end module shown in FIG. 11 of the drawings.

Reference is now made to FIGS. 11 to 14 which show details of the end modules 14 and 16. As mentioned, these modules are identical to each other, and therefore describing the end module 16 in effect describes both. FIG. 11 shows the end module 16 including the base 26 with a serrated or zigzag surface 78. The end module 16 comprises a substantially vertical end wall 80, and an inclined or graded wall 82. A triangular aperture 84 extends through the center of the end module 16.

Figure 13:
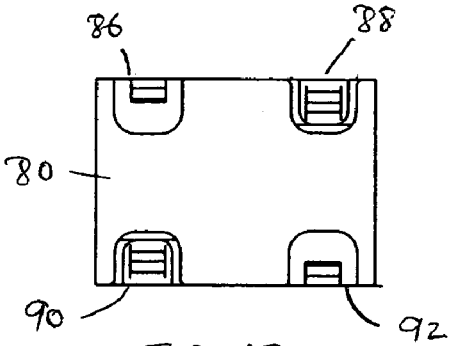
FIG. 13 is an end view of the end module shown in FIG. 11 of the drawings, including illustration of the various connector tabs.
Figure 14:
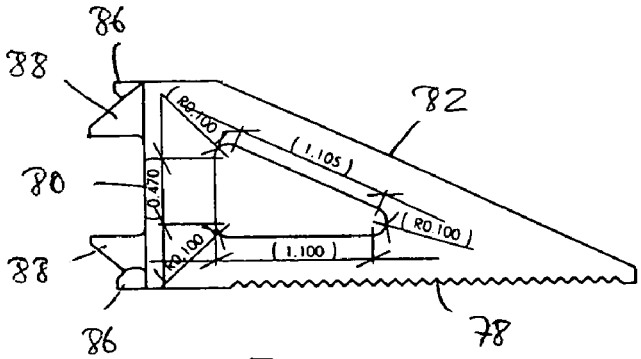
FIG. 14 is a side view of the end module shown in FIG. 11 of the drawings.

The end wall 80, clearly seen in FIG. 13 of the drawings, has four connectors. These are an upper female connector 86, an upper male connector 88, a lower male connector 90 and a lower female connector 92. The height of the end wall 80 is equivalent to the height of two cable modules 18 and 20 when mounted and fastened to each other, such as, for example, as seen in FIG. 1 of the drawings. The lower female connector 90 and lower male connector 92 engage with corresponding complementary connectors on the lower cable module 20. Correspondingly, the upper female connector 86 and the upper male connector 88 engage with complementary connectors formed on the upper cable module 18.

The particular construction of the male and female connectors formed in the end wall 80 of the end module 16 will not be discussed in any detail, since they are substantially identical in structure to the male and female connectors respectively formed on the end walls of the cable module.

The end module 16, while not essential to the modular cable guide 10 of the invention, can be omitted, but, when present, adds stability and firmness thereto. The end module 16 not only has the effect of providing an improved connection between connected cable modules 18 and 20, but also provides a more secure and enlarged base for the modular cable guide 10 generally, and thereby reduces the possibility that it may be moved, rotated or otherwise displaced during use.

Figure 15:
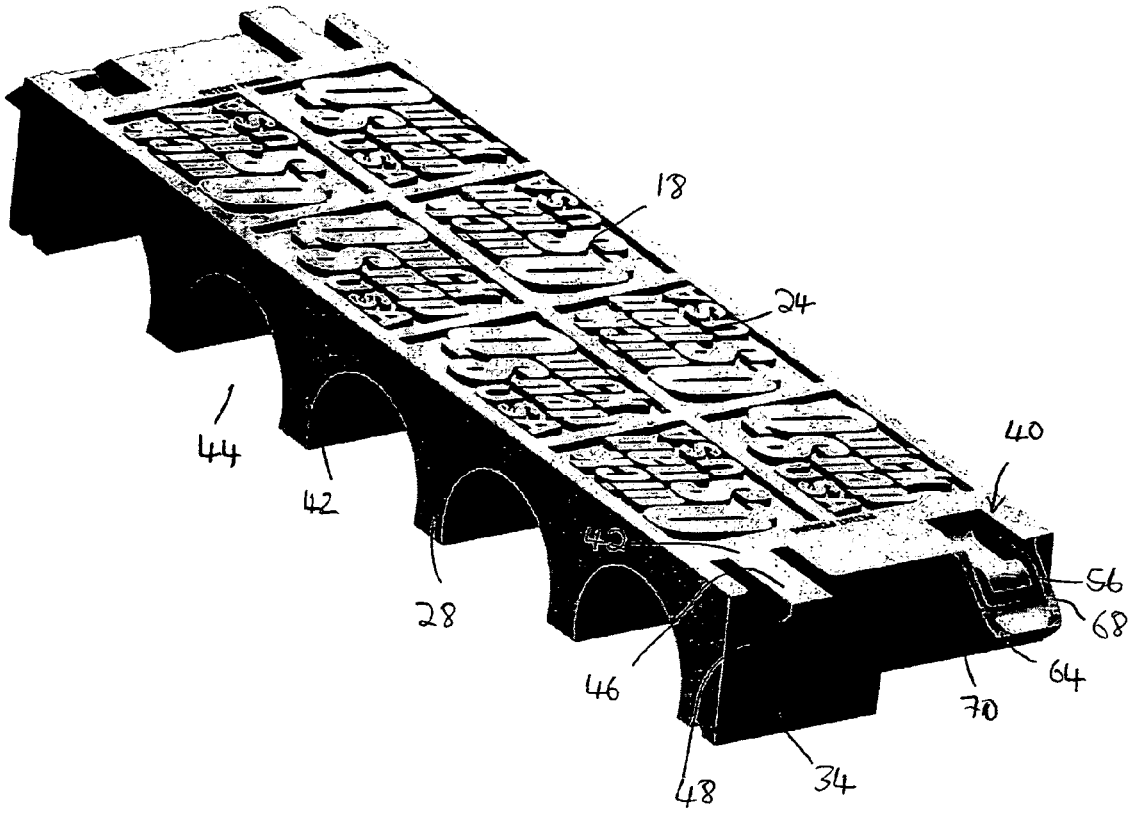
FIG. 15 is a perspective view of a cable guide module in accordance with an embodiment of the present invention, when viewed from the outside.

FIG. 15 of the drawings shows a perspective view of the upper cable module 18, including upper surface 24, side wall 28 and second end wall 34. Furthermore, the male connector 40 and female connector 42 can be clearly seen, including the hood 64 and side lock tab 56 of the male connector 40, and the hood recess 48 and side lock tab 46 of the female connector 42. Further, a series of five canals 44 are shown.

Figure 16:
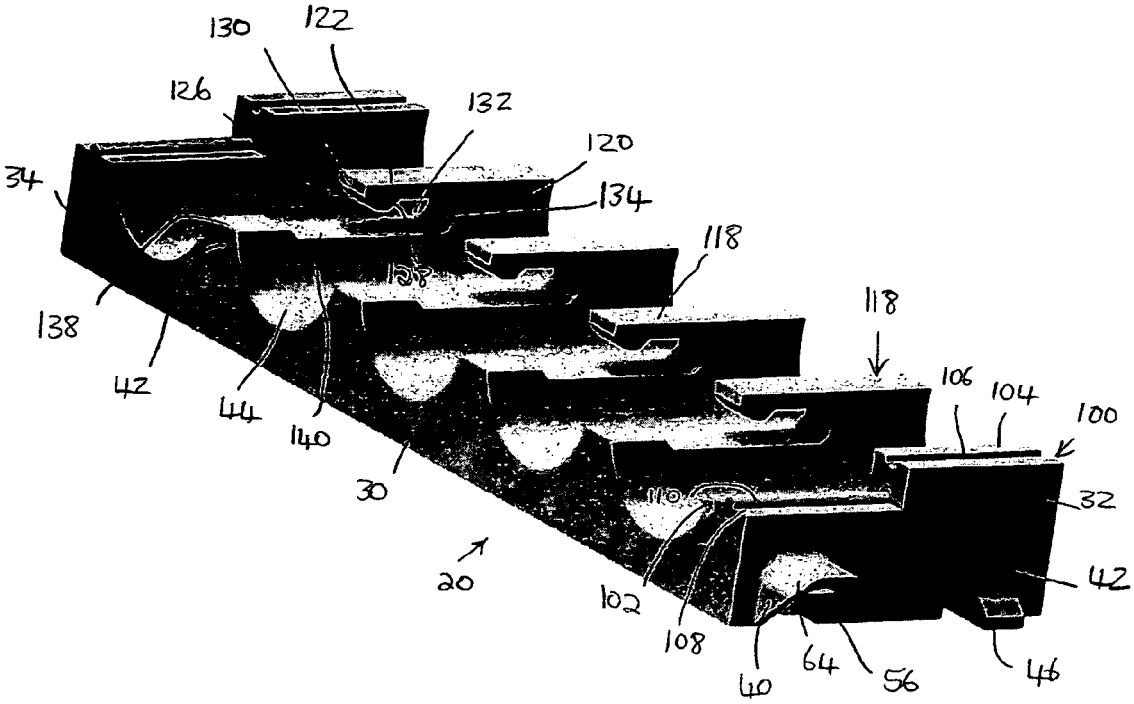
FIG. 16 is a perspective view of the body module shown in FIG. 15 of th drawings, rotated through 180 degrees to show the inner configuration thereof.
Figure 17:
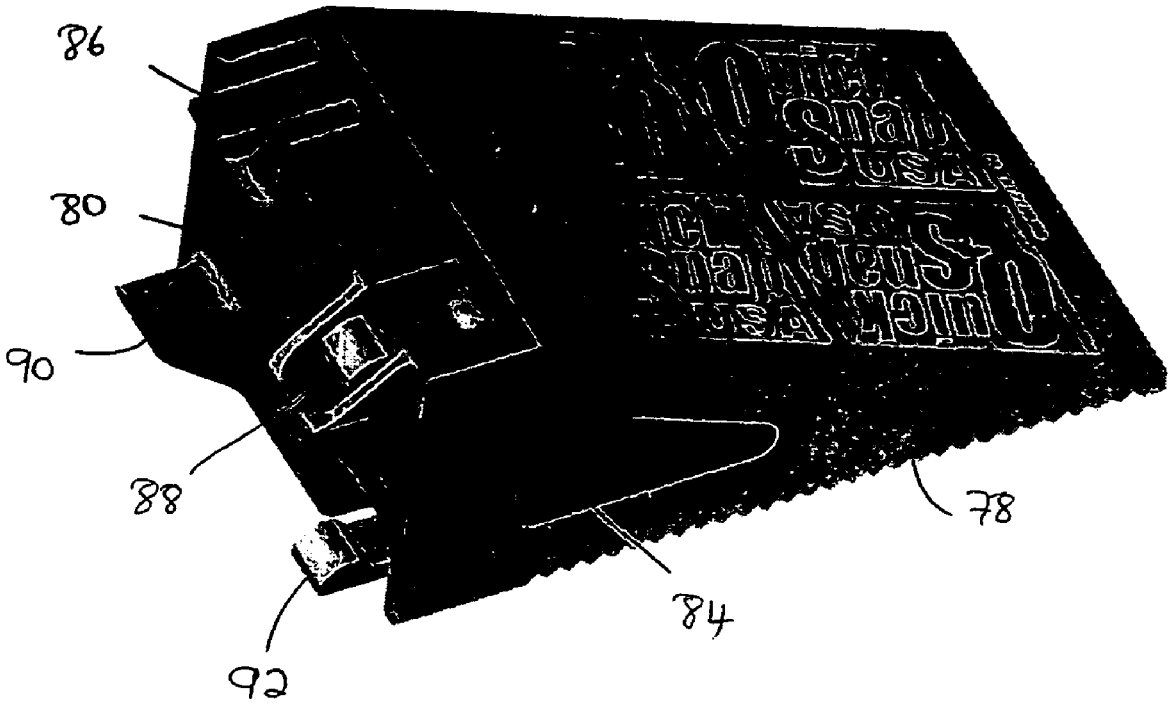
FIG. 17 is a perspective view of an end module used with the body module shown in FIGS. 15 and 16 of the drawings.

In FIG. 16 of the drawings, a perspective view of the lower connector module 20 is shown, including side wall 30 and end wall 32. Extending from the end wall can be seen the male connector 40, and the female connector 42, including the hood 64 on the male connector and the mirror image side lock tabes 56 and 46 respectively.

FIG. 16 also shows certain details relating to the end walls 32 and 34, and illustrates the structure of the locking members by means of which a cable module 18 can be secured to a cable module 20.

With respect to the end wall 32, it will be noted that approximately half the width of the end wall 32 comprises a raised step 100, while the other half comprises a lowered step 102. The raised step 100 has a flat surface 104, and within the flat surface 104, a substantially central recess 106. The lowered step 102 also has a flat surface 108, and substantially centered on the flat surface 108 is a projecting strip 110, of complementary shape, size and dimension to the recess 106.

When an upper cable module 18 is located over a lower cable module 20, as shown in FIG. 16, the raised step 100 of upper cable module 18 will engage with the lowered step 102 of the lower cable module 20. Furthermore, the raised step 100 of the lower cable module 20 engages with the lowered step 102 of the upper cable module 18. In this respective engagement, the opposing flat surface 104 and 108 abut and engage each other, and the projecting strip 110 is received within the recess 106. The accommodation of the projecting strip 110 within the recess 106 adds lateral stability to the connection between the upper and lower cable modules 18 and 20 respectively, helping to prevent end-over-end movement of the cable modules with respect to each other.

The upper and lower cable modules 18 and 20 releasably connect to each other by means of a series of locking members 118. Each locking member 118 comprises a body portion 120 which is positioned on an intermediate wall 42, described above. The body portion 120 has extending therefrom a locking arm 122. The locking arm 122 terminates in a locking tab 124, the locking tab 124 having a slide wall 126, and an abutment wall 128, on each side respectively thereof. The locking arm 122 further comprises an end 130.

The locking arm 122, being comprised of a resilient material, is able to move in a limited fashion in an up-and-down direction. This will in fact occur when a pair of cable modules are fitted together, as will be described.

The intermediate wall 42 and the locking arm 122 define therebetween a tab receiving recess 132, the recess 132 having a rounded limit wall 134.

On the side of the cable module 20 substantially opposite that of the body portion 120, there is formed a crest 138, and an elongate depression 140 extends along the intermediate wall 42 between the crest 138 and the limit wall 134.

It will be apparent from the description of the structure of the body portion 120 of the locking member 118 that the locking members 18 of upper and lower cable modules 18 and 20 respectively engage with each other to create a firm, but releasable, connection between such modules.

When assembling upper and lower cable modules together so as to form the modular cable guide 10 as illustrated in the drawings, the upper cable module 18 is placed above the lower cable module 20, such that they are vertically off-set from each other. In a vertical plane, the ends 130 of the locking members 118 should be on opposing sides of such a vertical plane. The upper and lower cable modules 18 and 20 respectively are then moved closer towards each other, such that the locking arm 122 of one cable module slides under the lock tab 124 of the other cable module, and into the tab receiving recess 132. In so doing, the slide wall 126 on the locking member 118 of one cable module will engage the slide wall 126 on another. As these slide walls 126 move over each other, the locking members 118 are forced apart from each other slightly, and are able to move into the elongate depression 140 formed between the crest 138 and the limit wall 140. The angle of the slide walls 126 is such that the moving together of the cable modules 18 and 20 has the effect of pushing the locking members 118 of each cable module apart from each other.

Once the lock tabs 124 have moved past each other, as described, the lock tabs 124 move into the tab-receiving recess 132, and the end 130 of a locking member 118 engages or abuts the limit wall 134 on the other cable module. Further inward movement of the upper cable module 18 relative to the lower cable module 20 is thus prevented.

It will be appreciated that the abutment of the end 130 on the limit wall 134 of two connected cable modules 18 and 20 prevents further side-to-side movement, while the engagement of the projecting strips 110 in recesses 106 of connected cable modules prevents end-over-end movement. A fairly stable and secure mechanism is thus provided to effect fastening of two identically configured and structured cable modules.

In order to separate two fastened cable modules from each other, it is only necessary to reverse the procedure as described with respect to the connection. Sufficient force pushing the upper and lower cable modules 18 and 20 away from each other in a side-over-side fashion allows the abutment walls 128 on the different cable modules to slide over each other and to push the locking arms 122 outwardly, so that the lock tabs 124 can be disengaged and removed from the tab-receiving recess 132.

Figure 19:
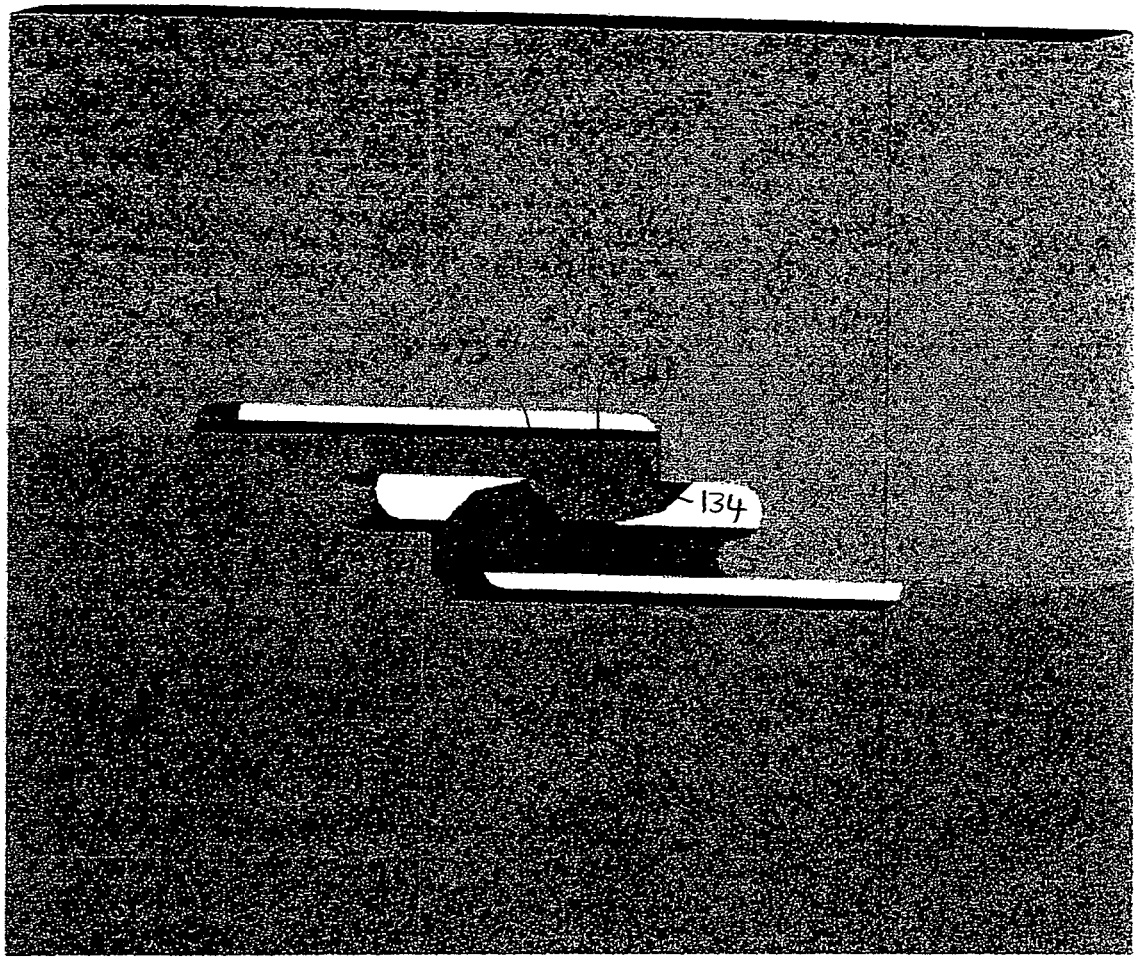
FIGS. 19(*a*), 19(*b*) and 19(*c*) of the drawings show the sequential mechanism for snapping together, or pulling apart, body modules similar but not identical to those shown in FIGS. 16 to 18 of the drawings.
Figure 19:
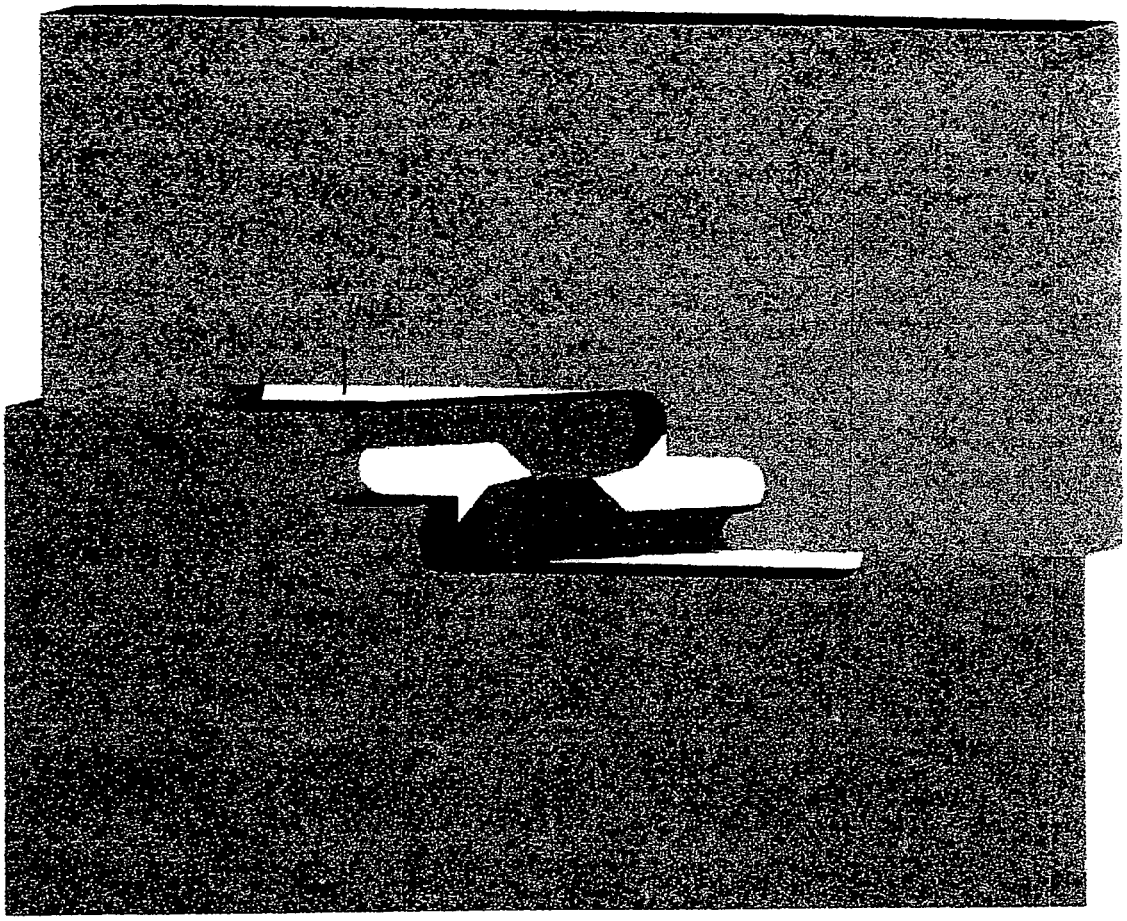
Figure 19:
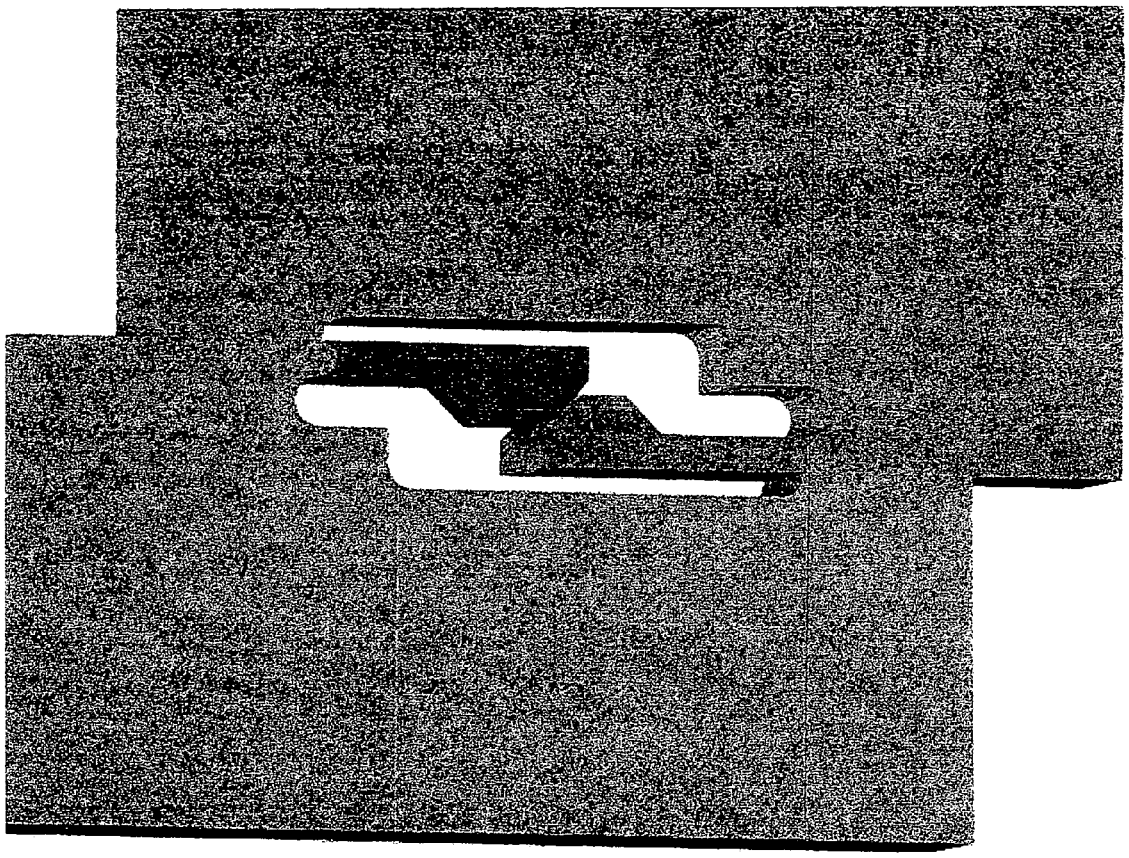

FIGS. 19(*a*), 19(*b*) and 19(*c*) show the sequential disengagement steps for cable modules having a structure not identical with, but similar to, that described and illustrated in FIG. 16 of the drawings. FIG. 19(*a*) shows the two cable modules connected to each other, with the lock tabs 124 locked in between the abutment wall 128 and the limit wall 134 of the other cable module. In FIG. 19(*b*), the cable modules are pulled apart, showing the movement of each of the locking arms 122 into the elongate depression 140, in the course of separating from each other. In FIG. 19(*c*), the lock tabs 122 have moved past each other, essentially permitting the cable modules to be easily pulled apart from each other.

It will be appreciated from the above that a modular cable guide 10 containing any number of channels 22 as desired may be created by appropriately assembling a cable module of one particular configuration. First, substantially identical cable modules can be placed over each other so as to create the central portion 12, as illustrated in FIG. 1. Thereafter, if more than five channels 22 are desired, such as ten, another vertically connected pair of cable modules can be assembled, and connected in a side-to-side configuration with the first assembled pair, by appropriate interconnection of the male and female connectors. When sufficient channels 22 have been created, the optional end module 16 may be secured at each end thereof.

Thus, a highly effective and efficient mechanism is created whereby a cable guide can be assembled using a plurality of single cable modules, connected to each other in a manner described above.

Preferably, the cable unit is constructed from a polyurethane plastic or similar material, and preferably is flame-resistant or flame-retardant in order to ensure that the cable module will not catch on fire in case of an electrical short.

The modular cable guide can, in one arrangement, replace the "basket weaving" method of controlling a large number of cables. This is a rope that it woven in and out of the cable. It is a time consuming operation, both in terms of its assembly and subsequent dismantling. On the other hand, the cable module of the present invention can be snapped together in any number of forms quickly and efficiently, to assemble the guide, and can thereafter be removed just as readily.

Figure 18:
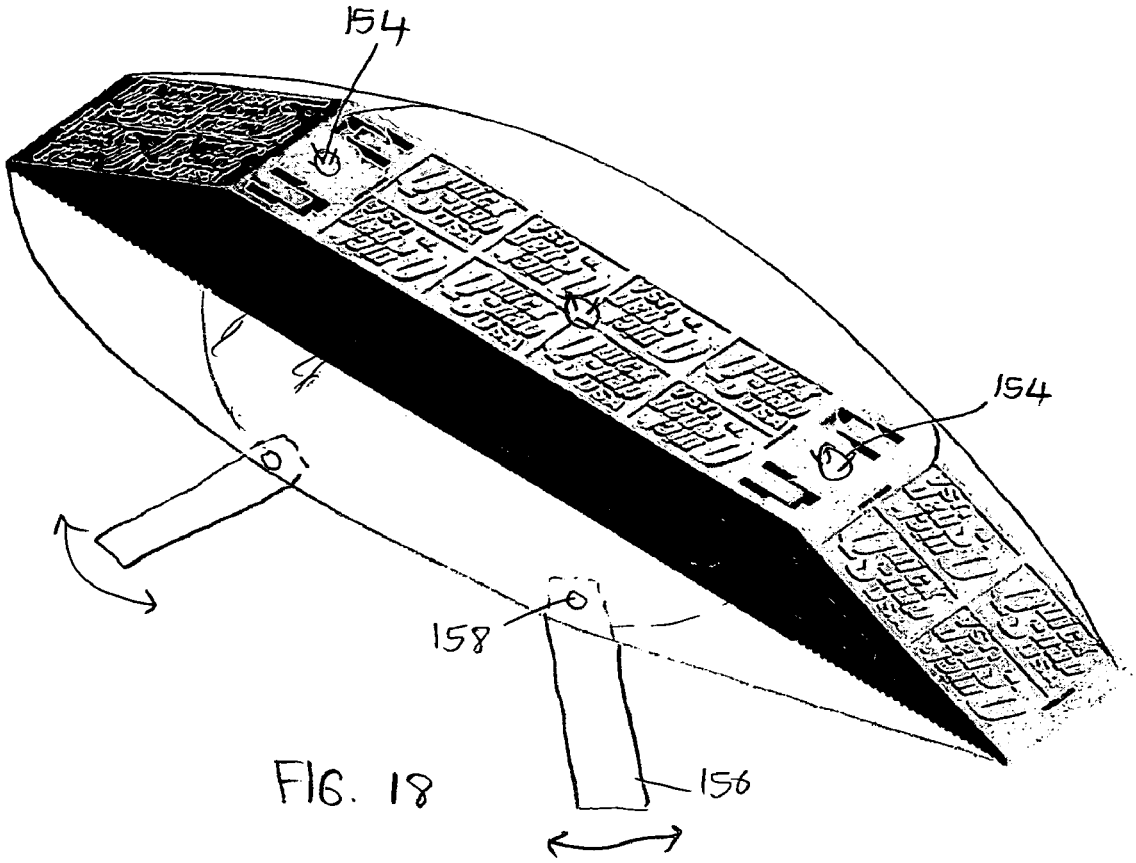
FIG. 18 is a perspective view of an assembled modular cable guide using the body module of FIG. 15 and the end module of FIG. 17 of the drawings.

FIG. 18 shows some variations, including a unit which, instead of being rectangular, may be somewhat circular in shape, with sloped or graded walls in a 360 degree circle. This would avoid tripping hazards, and provide easier surfaces by means of which other equipment, such as carts or wheeled devices, may be moved over an area containing such cable guides.

Further, in FIG. 18, one or more LED lights 154 may be provided on the upper surface or other parts of the module, and these may be such that they light up in response to the presence of a cable inside a channel when electrically powered. Alternatively, the lights may be powered by a battery in the unit, providing a visible cautionary warning to the presence of the guide to people in the vicinity.

It will also be appreciated that the number of holes or channels in a particular cable module may vary, as may their size. Thus, the examples in the illustrated drawings accompanying the specification generally show a module with five channels. However, the module may only have one hole, or any number up to five and beyond. Further, the holes may be circular, of 1 inch diameter, or any other convenient shape, and having different diameters. Any one module may have channels with a variety of diameters. Thus, for example, if a module has four channels, one may be of ¾ inch diameter, two may be of 1 inch diameter, and one may be of 1.5 inch diameter. Any combination thereof would fall within the scope of this invention.

In yet another variation, the module, generally shown as rectangular, in many of the embodiments may have varying widths, such as, from 2 inches to 4 inches or more. The width of the diameter may be selected based on the need to increase the stability of the device in use, or the size of the cables to be placed in the guide.

In yet another example, the device may have fold-out arms 156, which rotate about pivot point 158, and can slide or rotate between a closed position for storage, and an open position, extending away from the cable module, so that when extended, additional stability to reduce or prevent movement or rotation of the cable module guide, is achieved.

The invention, is not, of course, limited to the precise details described herein, but may vary significantly. One form of tab connection, and male and female connection, is described in the specification, but any other form of fastening to achieve a releasable effect between adjacent modules, whether vertically or serially arranged with respect to each other, would fall within the scope of the invention.

The invention claimed is:

1. A cable guide module comprising:

a body portion having end walls and at least one groove therein extending across the body portion between the end walls, the groove having a first open end and a second open end;

attachment means on the body portion for releasably securing the body portion of a first cable guide module to the body portion of a second cable guide module such that the grooves of the first and second cable guide modules together define a channel; and an end module releasably connectable to each of the end walls of the body portion, the end module when connected to the body portions of the first and second cable guide modules secured to each other having an inclined surface which operates as a ramp between the body portion and a surface on which the cable guide module is located.

2. A cable guide module as claimed in claim 1 wherein the grooves are substantially semicircular in shape.

3. A cable guide module as claimed in claim 1 wherein the end wall of the body portion comprises a fastening member having a male connector and a female connector and the end module comprises an end face having a fastening member having a female connector and male connector, the male connector and the female connector on the end wall of the body portion being complementary with and fastening to the female connector and the male connector on the end face of the end module.

4. A cable guide module as claimed in claim 1 wherein the end module comprises a substantially vertical end face, a substantially horizontal base member, and an inclined wall.

5. A cable guide module as claimed in claim 1 wherein the body portion has a textured surface over selected areas thereof to enhance its grip on or with other surfaces.

6. A cable guide module as claimed in claim 1 wherein the body portion is shaped from the group consisting of: circular, elliptical, square and rectangular.

7. A cable guide module as claimed in claim 1 further comprising lighting thereon.

8. A cable guide module as claimed in claim 1 further comprising retractable arms for stabilizing the body portion.

9. A cable guide module as claimed in claim 1 comprised of polyurethane.

10. A cable guide module as claimed in claim 1 wherein the body portion comprises a plurality of grooves therein which are substantially parallel to each other.

11. A cable guide module as claimed in claim 10 wherein the body portion has a selected number of grooves of substantially the same size.

12. A cable guide module as claimed in claim wherein the body portion has a selected number of grooves, the grooves being of at least two sizes.

13. A cable guide module as claimed in claim 1 wherein the body portion is approximately rectangular in shape including a pair of side walls and a pair of end walls, the groove extending between the side walls.

14. A cable guide module as claimed in claim 13 wherein each of the end walls of the body portion is stepped and comprises a raised step and a lowered step.

15. A cable guide module as claimed in claim 14 further comprising a grooved recess along at least a portion of the raised step and a corresponding projecting strip on the lowered step.

16. A cable guide module as claimed in claim 13 wherein the end walls comprise a fastening member which can be releasably secured to a fastening member of an adjacent body portion.

17. A cable guide module as claimed in claim 16 wherein the fastening member on one end of the body portion comprises a male connector and a female connector and the fastening member on the other end of the body portion comprises a female connector and male connector, the male connector and the female connector on the one end being complementary with and fastening to the female connector and the male connector on the other end.

18. A cable guide module as claimed in claim 17 wherein:

the male connector comprises a locking arm having a raised tab thereon extending outwardly from the end of the body portion and a hood member at least partially surrounding the locking arm; and the female connector comprises a locking arm having a raised tab thereon extending outwardly from the end of the body portion and a hood recess at least partially surrounding the locking arm;

the raised tabs on the locking arms of the male and female connectors respectively being configured so that they can releasably engage one another, and the hood member being dimensioned for receipt in the hood recess.

19. A cable guide module as claimed in claim 1 wherein the attachment means comprises at least one lock member formed on the body portion.

20. A cable guide module as claimed in claim 19 wherein the body portion comprises intermediate walls between adjacent grooves, and the lock member is located on the intermediate walls.

21. A cable guide module as claimed in claim 20 wherein the body portion has substantially opposing sides and the lock member comprises a lock wall at one side of the body portion and a fingerlike projection extending from the lock wall toward an other side of the body portion, the fingerlike projection having a tab member for engaging a like tab member on another body portion.

22. A cable guide module as claimed in claim 21 wherein the tab member on the fingerlike projection comprises a downwardly directed bulge having an inclined slide surface and an inclined abutment surface, the bulge being positioned with respect to the body portion so that it is at least partially slightly beyond a center line and away from the lock wall, between the opposing sides of the body portion.

23. A cable guide module as claimed in claim 22 wherein the fingerlike projection and the intermediate wall over which it is positioned define a space therebetween for receiving a fingerlike projection of another body portion, the space being open below the bulge and closed at the lock wall, the lock wall defining a barrier to limit movement of a fingerlike projection received therein.

24. A cable guide module as claimed in claim 23 wherein the intermediate wall has a crest thereon near the opposing side opposite the opposing side where the lock wall is located, an elongate depression being formed between the crest and the lock wall.

25. A modular cable guide comprised of a plurality of assembled cable guide modules, each cable guide module comprising:

a body portion having end walls and at least one groove therein extending across the body portion, the groove having a first open end and a second open end;

attachment means on the body portion for releasably securing the body portion of a first cable guide module to the body portion of a second cable guide module such that the grooves of the first and second cable guide modules together define a channel; and the modular cable guide further comprises an end module releasably connectable to each of the end walls of the body portion, the end module when connected to the body portions of the first and second cable guide modules secured to each other having an inclined surface which operates as a ramp between the body portion and a surface on which the cable guide module is located.

26. A method of forming a modular cable guide comprising:

forming a body portion having end walls and at least one groove therein extending across the body portion, the groove having a first open end and a second open end;

providing attachment means on the body portion for releasably securing the body portion of a first cable guide module to the body portion of a second cable guide module such that the grooves of the first and second cable guide modules together define a channel;

snapping together the first cable guide module and the second cable guide module using the attachment means; and attaching to at least one of the end walls of the snapped together first and second cable guide modules an end module which has an inclined surface forming a ramp between a substrate on which the modular cable guide is located and the body portion.

* * * * *